US008407939B2

(12) United States Patent
Schachtl et al.

(10) Patent No.: US 8,407,939 B2
(45) Date of Patent: Apr. 2, 2013

(54) DEVICE FOR THE TRANSFER OF A TORQUE

(75) Inventors: Stephan Schachtl, Creteil Cedex (FR); Eric Bittner, Creteil Cedex (FR); Markus Pflueger, Creteil Cedex (FR); Armin Dietl, Creteil Cedex (FR)

(73) Assignee: Valeo Sicherheitssysteme GmbH, Erdweg (DE)

( * ) Notice: Subject to any disclaimer, the term of this patent is extended or adjusted under 35 U.S.C. 154(b) by 277 days.

(21) Appl. No.: 12/303,197

(22) PCT Filed: May 23, 2007

(86) PCT No.: PCT/EP2007/055028

§ 371 (c)(1),
(2), (4) Date: Dec. 2, 2008

(87) PCT Pub. No.: WO2007/135181

PCT Pub. Date: Nov. 29, 2007

(65) Prior Publication Data

US 2009/0255185 A1 Oct. 15, 2009

(30) Foreign Application Priority Data

May 24, 2006 (DE) ..... 10 2006 024 349

(51) Int. Cl.
*E05F 15/02* (2006.01)

(52) U.S. Cl. ..... 49/334; 49/333; 49/335; 49/338; 296/55

(58) Field of Classification Search ..... 49/333, 49/334, 335, 338, 280, 336, 337; 296/76, 296/55

See application file for complete search history.

(56) References Cited

U.S. PATENT DOCUMENTS

| | | | | | |
|---|---|---|---|---|---|
| 895,013 | A | * | 8/1908 | Hanington | 49/341 |
| 1,051,357 | A | * | 1/1913 | Voight | 49/338 |
| 1,129,391 | A | * | 2/1915 | Hohne et al. | 49/30 |
| 1,142,319 | A | * | 6/1915 | Gasse | 49/334 |
| 2,351,285 | A | * | 6/1944 | Parsons | 49/138 |
| 2,679,991 | A | * | 6/1954 | Eagon | 244/74 |
| 3,092,377 | A | * | 6/1963 | Arlauskas | 49/338 |
| 4,415,194 | A | * | 11/1983 | Bauer | 296/76 |

(Continued)

FOREIGN PATENT DOCUMENTS

| | | | |
|---|---|---|---|
| DE | 199 34 629 | A1 | 2/2001 |
| WO | 03/097978 | A | 11/2003 |

(Continued)

OTHER PUBLICATIONS

International Search Report from PCT/EP2007/055028 dated Sep. 13, 2007 (2 pages).

*Primary Examiner* — Katherine Mitchell
*Assistant Examiner* — Marcus Menezes
(74) *Attorney, Agent, or Firm* — Osha Liang LLP

(57) ABSTRACT

A device lor the transfer of a torque from an output shaft of a drive mounted on the body of a motor vehicle with a rotational axis of the output shaft and a hinge axis arranged flush with one another. The device includes a drive lever rotationaily connected to the output shaft of the drive, a connecting member on the drive lever extending from a connecting region of the drive lever. The connecting member includes a sliding block and an adapter part that is connected to a first half of a hinge and is provided with a journal. The journal rotates directly in, but independently of, the sliding block.

4 Claims, 2 Drawing Sheets

U.S. PATENT DOCUMENTS 4,489,640 A * 12/1984 Olson ..... 91/189 R
4,739,585 A * 4/1988 Pickles ..... 49/280
5,052,730 A * 10/1991 Frank et al. ..... 292/201
6,092,335 A * 7/2000 Queveau et al. ..... 49/192
6,195,940 B1 * 3/2001 Moy ..... 49/324
6,357,813 B1 * 3/2002 Vandeberghe et al. ..... 296/57.1
6,367,199 B2 * 4/2002 Sedlak et al. ..... 49/340
6,378,392 B1 * 4/2002 Dombrowski et al. ..... 74/422
6,454,339 B2 * 9/2002 Wilde et al. ..... 296/76
6,513,859 B2 * 2/2003 Yuge ..... 296/146.4
6,767,048 B2 * 7/2004 Yokota ..... 296/146.4
7,287,803 B2 * 10/2007 Koneval et al. ..... 296/146.4
2009/0165387 A1 * 7/2009 Goldstein et al. ..... 49/340

FOREIGN PATENT DOCUMENTS

WO 2004/055309 A 7/2004

* cited by examiner

DEVICE FOR THE TRANSFER OF A TORQUE

FIELD OF THE INVENTION

The invention relates to a device for the transfer of a torque from an output shaft of a drive that can be mounted on the body of a motor vehicle to a first hinge half of a hinge having a hinge axis, which first hinge half is attached to a vehicle gate of the motor vehicle, with the rotational axis of the output shaft and the hinge axis being arranged essentially flush with one another in the mounted state of the drive.

BACKGROUND OF THE INVENTION

Such a device is known, for example, from DE 102 22 298 A1. Therein, the device comprises a drive lever which is formed in the manner of a strap and which can be connected by its first end to the output shaft of a tailgate drive in a rotationally fixed manner. The drive lever is adapted to the shape of the first hinge half (which is also referred to as a hinge strap) in terms of its shape and can be attached by its second end, which faces away from the output shaft and is formed in a flange-like manner, on the end, which faces the tailgate, of the first hinge half such that, in the mounted state of the drive, in the event of rotation of the output shaft, the drive lever arranged parallel to the hinge half is pivoted and can carry along the first hinge half and the tailgate.

In the case of the known device, the drive lever and the first hinge half are adapted to one another such that, in the event of a subsequent installation of a tailgate drive, the tailgate hinge which is already present and has to be connected to the drive cannot generally be used. Moreover, due to the tolerances of the tailgates in different vehicles and the tolerances of the dimensions of the drives, mounting problems may occur if account has not been taken of these tolerances by means of corresponding bearing plays. However, the greater the play between drive and tailgate, the higher the speed of the tailgate in front of the lock must be so that the tailgate fully closes.

The object of the invention is to indicate a device of the type cited at the outset in which a gate drive, preferably for a tailgate, can also be subsequently installed in a simple manner in a motor vehicle without the existing hinge having to be replaced. In this case, the angle and length tolerances of the drive and the vehicle gate should be balanced out in a simple manner in order to ensure that the gate drive can be mounted quickly and to achieve an optimum displacement path of the vehicle gate during the closing process.

SUMMARY OF THE INVENTION

The invention is essentially based on the concept of using a drive lever which can be connected to the output shaft in a rotationally fixed manner and which, axially spaced apart from the connecting region of the output shaft, has a connecting member extending in the direction of the longitudinal axis of the drive lever, in which connecting member a sliding block is displaceably arranged. This sliding block forms the pivot bearing of the journal of a preferably plate-like adapter part which connects the drive lever to the first hinge half.

In the case of the device as claimed in the invention, the drive lever neither needs to have a strap-like shape adapted to the first hinge half, nor does the end of the drive lever have to be connected to the end of the first hinge half. Rather, the length of the drive lever, which is, for example, formed straight, depends on the location at which the adapter part is supposed to be attached expediently on the first hinge half, wherein the rotational axis of the journal runs parallel to the hinge axis. A balancing out of the tolerances of drive and tailgate is ensured by the rotatable mounting of the journal connected to the adapter part in the sliding block and the displaceability of the sliding block.

It has proved to be advantageous if the drive lever and the adapter part are formed and connected to one another in such a manner that the adapter part can be attached in the strap-like region, which adjoins the hinge axis, of the first hinge half.

The play which occurs between drive and tailgate during their intended use is significantly reduced in comparison to known devices and the displacement path and the function are thus improved.

Moreover, in the case of subsequent fitting of a tailgate drive, the gate hinge which is already present can generally still be used. The only requirement is that a bore hole is made in this hinge half to connect the first hinge half to the adapter part such that the adapter part can be attached in a non-positive manner to the first hinge half, for example, by means of a screw.

The output shaft of the drive and the drive lever can be connected to one another by means of a positive or non-positive connection. It has proved to be particularly advantageous if, in the event of a positive connection, a spline shaft connection is used.

BRIEF DESCRIPTION OF THE DRAWINGS

Further details and advantages of the invention will become apparent from the following exemplary embodiments explained with reference to figures. In these figures.

DETAILED DESCRIPTION

Figure 1:
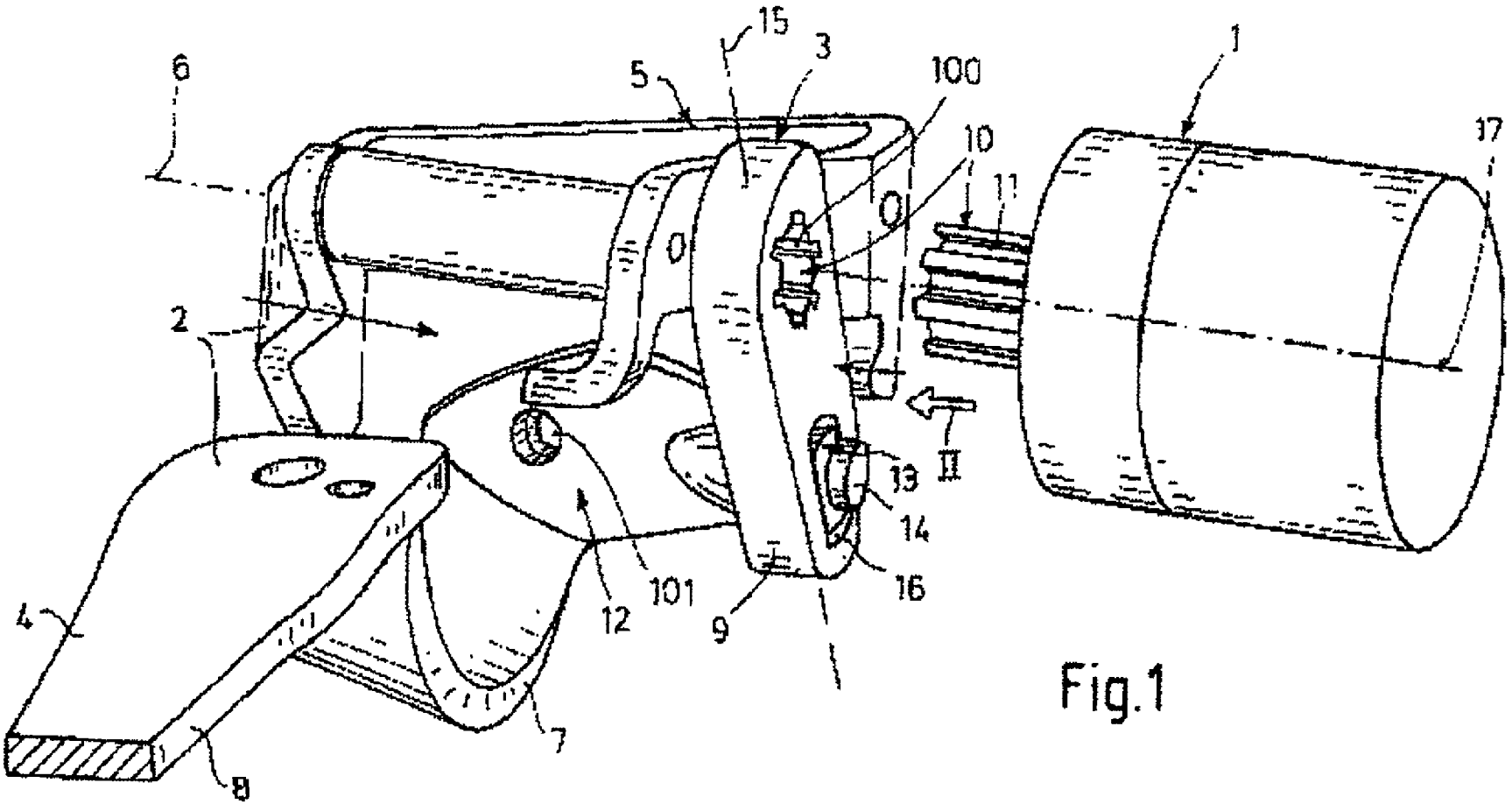
FIG. 1 shows a perspective representation of a device as claimed in the invention, which is connected to the first hinge half of a tailgate hinge, as well as a drive with an output shaft prior to connection of the output shaft to a drive lever of the device as claimed in the invention

In FIG. 1, 1 designates a tailgate drive which is known per se, 2 designates a hinge which is known per se and 3 designates a device as claimed in the invention.

Hinge 2 comprises two hinge halves 4, 5 which are connected to one another via a hinge pin, not shown, and are pivotable relative to one another about a hinge axis 6. First hinge half 4 has a strap-like region 7 and a straight flange-like region 8 which serves to connect first hinge half 4 to the tailgate, not shown, of a motor vehicle, also not shown.

Second hinge half 5 can be connected at the roof support to the body of the motor vehicle, not shown.

Device 3 as claimed in the invention essentially encompasses a drive lever 9 which can be connected to output shaft 11 of drive 1 in a rotationally fixed manner via a spline shaft connection 10 and a plate-like adapter part 12 connected to drive lever 9, which adapter part 12 can be connected to first hinge half 4 in a rotationally fixed manner, for example, via a screw connection (FIG. 1 shows only the bore holes designated by 101 for the screw connection).

As is apparent from FIG. 1, drive lever 9 and adapter part 12 are formed and connected to one another such that adapter part 12 is attached in strap-like region 7, which adjoins hinge axis 6, of first hinge half 4.

Figure 2:
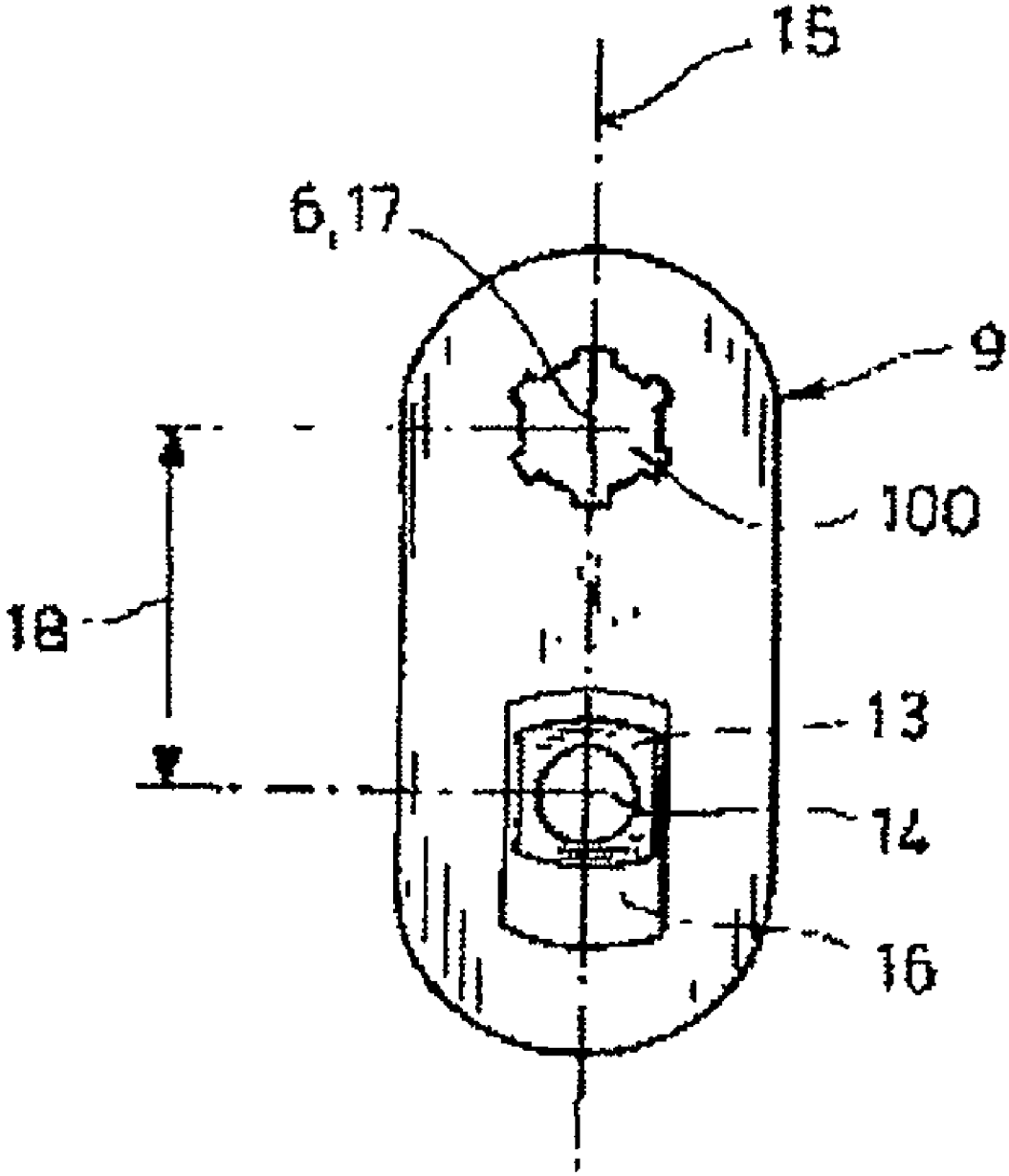
FIG. 2 shows a side view of the drive lever shown in FIG. 1 from the side designated by II in FIG. 1.

The connection between drive lever 9 and adapter part 12 is performed by means of a sliding block 13 in which a journal 14 arranged at the end of adapter part 12 is rotatably mounted. Sliding block 13 is displaceably arranged in a connecting member (longitudinal hole) 16 extending in the direction of longitudinal axis 15 (FIG. 2) of drive lever 9. In this case, adapter part 12 and sliding block 13 are secured against falling out of connecting member 16 by parts, not shown (e.g. a disc arranged on the journal or a split-pin or the like).

If tailgate drive 1 and hinge 2 are connected via device 3 as claimed in the invention and output shaft 11 of drive 1 now rotates, due to the positive connection of output shaft 11 and drive lever 9, drive lever 9 also rotates around rotational axis 17 of output shaft 11 and thus also about hinge axis 6 whose position essentially corresponds to rotational axis 17. As a result, journal 14 of adapter part 12 mounted in sliding block 13 at an axial distance 18 from rotational axis 17 is also pivoted and thus also first hinge half 4 connected to the tailgate.

Since drive lever 9 is both pivotable about journal 14 of adapter part 12 and, due to connecting member 16, is displaceable in the direction of its longitudinal axis 15, tolerances between the position of drive 1 (or of drive shaft 11) and the tailgate (or first hinge half 4) are balanced out.

LIST OF REFERENCE NUMBERS

1 Tailgate drive, drive
2 Hinge
3 Device as claimed in the invention
4 First hinge half
5 Second hinge half
6 Hinge axis
7 Strap-like region
8 Flange-like region
9 Drive lever
10 Spline shaft connection
11 Output shaft
12 Adapter part
13 Sliding block
14 Journal
15 Longitudinal axis
16 Connecting member
17 Rotational axis
18 Distance
100 Connecting region
101 Bore hole

The invention claimed is:

1. A device for the transfer of a torque from a rotatable output shaft of a drive mounted on the body of a motor vehicle to a rotatable first hinge half of a hinge having a hinge axis, wherein the first hinge half is attached to a vehicle gate of the motor vehicle, with a rotational axis of the output shaft and the hinge axis arranged flush with one another in the mounted state of the drive, the device comprising:

a rotatable drive lever fixedly connected to the output shaft of the drive in a connecting region;

a connecting member on the drive lever which is axially spaced apart and extends from the connecting region of the drive lever in the direction of the longitudinal axis of the drive lever, wherein the connecting member comprises a sliding block that is displaceably arranged; and an adapter part that is fixedly connected to the first hinge half of the hinge and is provided with a journal which is rotatably mounted in the sliding block, wherein the journal rotates directly in, but independently of, the sliding block, and wherein the adapter part is formed as a plate on a side of the adapter part facing the first hinge half.

2. The device as claimed in claim 1, wherein the output shaft of the drive and the drive lever are connected to one another via a spline shaft connection.

3. The device as claimed in claim 1, wherein the adapter part is attached to the first hinge half by means of a screw connection.

4. The device as claimed in claim 1, wherein the drive lever and the adapter part are formed and connected to one another such that the adapter part is attached in a curved region, which adjoins the hinge axis, of the first hinge half.

* * * * *